US006742294B1

(12) United States Patent
Fossum

(10) Patent No.: US 6,742,294 B1
(45) Date of Patent: Jun. 1, 2004

(54) DEVICE FOR DISPLAYING INFORMATION

(76) Inventor: Stein Arne Fossum, Bjornestupet 25, 1453 Bjornemyr (NO)

( * ) Notice: Subject to any disclaimer, the term of this patent is extended or adjusted under 35 U.S.C. 154(b) by 0 days.

(21) Appl. No.: 09/890,822

(22) PCT Filed: Feb. 4, 2000

(86) PCT No.: PCT/NO00/00039

§ 371 (c)(1),
(2), (4) Date: Aug. 24, 2001

(87) PCT Pub. No.: WO00/46779

PCT Pub. Date: Aug. 10, 2000

(30) Foreign Application Priority Data

Feb. 5, 1999 (NO) ..... 19990553

(51) Int. Cl.[7] ..... G09F 7/02
(52) U.S. Cl. ..... 40/611.1; 40/661
(58) Field of Search ..... 248/302, 175, 248/475.1; 40/606, 661, 661.08, 650, 904, 761, 762, 745, 716, 611

(56) References Cited

U.S. PATENT DOCUMENTS 2,730,825 A 1/1956 Wilds
2,902,787 A * 9/1959 Cook ..... 40/716
3,514,886 A * 6/1970 Drakard ..... 40/761 X
3,608,220 A * 9/1971 Fryrear ..... 40/606
3,846,925 A 11/1974 Busse
4,270,288 A * 6/1981 Sulzer ..... 40/795

FOREIGN PATENT DOCUMENTS

FR 2765090 A1 12/1998
GB 2146160 A 4/1985

* cited by examiner

*Primary Examiner*—Joanne Silbermann
(74) *Attorney, Agent, or Firm*—Clifford W. Browning; Woodard, Emhardt, Moriarty, McNett & Henry LLP

(57) ABSTRACT

A device for displaying information, such as advertising, text, pictures or the like, comprising a wholly or partly transparent front plate (1) having an at least partly curved or bent cross section between a pair of essentially parallel side edges, and having first and second abutment members (4, 5) arranged along respective ones of the parallel edges at the concave side of the front plate (1), for retaining a display plate (6) in a fixed, curved condition between the abutment members, and a supporting means (30) for support of the front plate (1). The abutment members are gripping edges (4, 5) constituted by folded side edge portions of the front plate (1), and the supporting means consists of a support element (30) of a resilient material having opposite end portions (31, 32) shaped for releasable engagement with the gripping edges (4, 5) of the front plate (1), the element being arranged for resilient snap-in of the end portions (31, 32) to engagement with the gripping edges (4, 5) of the front plate (1).

12 Claims, 6 Drawing Sheets

DEVICE FOR DISPLAYING INFORMATION

The invention relates to a device for displaying information, such as advertising, text, pictures or the like, comprising a wholly or partly transparent front plate having an at least partly curved or bent cross-section between a pair of essentially parallel side edges, and having first and second abutment members arranged along respective ones of the parallel edges at the concave side of the front plate, for retaining a display plate in fixed, curved condition between the abutment members, and a supporting means for support of the front plate.

The device according to the invention is particularly intended for use where there is a need for inserting and exchanging, in a simple and quick manner, information that is to be displayed. The device is intended for use both as a usual framing system, and to be able to replace traditional sign systems, everything from small door and information signs to larger signs, advertising show-cases and light shafts.

Traditional sign and poster systems are made in that "the message" which is to be displayed, is either printed or painted on a plate or sheet, or consists of a foil mounted on a back plate. Both the used materials and the printing methods are expensive, since the display plates are to appear with a neat and durable surface. The sign and poster production is both time-consuming and expensive, and usually is carried out by separate sign makers and poster painters. When a sign or poster is produced, it is time-consuming and often difficult to change "message". Further, there are only a few parts of the system that are able to be reused.

Other systems consist of modules in the form of loose letters and/or symbols which can be mounted with different techniques in or on frame systems. The possibilities of variations in form and expression are then limited, and such systems require many loose parts which may easily be lost, and which are relatively expensive.

Ordinary framing systems solve many of the above-mentioned problems, since the message can be produced with cheaper methods and with a cheaper material in that it is mounted behind a transparent glass plate giving both protection and a pretty surface. Behind the glass plate, the message to be displayed is stretched and smoothed by means of different techniques, such as frames, mounting on a back piece or in passe-partout, or by the use of a rearward press plate. In addition there are used tape, pins, staples, spring systems, clips or the like. The drawback of these systems is more or less difficult mounting or changing of content, and that they consist of several loose parts which may be lost or can not be reused. Moreover, the technique becomes difficult to use beyond certain sizes.

Several different variants of display devices are known from the patent literature. Thus, for example, U.S. Pat. No. 2,919,512 shows an easel-like holder for displaying cards, wherein the holder at the back side has opposite flanges forming sliding grooves for lateral introduction of a card, and wherein a holding piece can be placed in one or both of said grooves.

Further, U.S. Pat. No. 4,270,288 shows a transparent picture frame consisting of a rigid, curved plastic plate having inclined edges, and a clamping member which may be snapped in place between the inclined edges and presses a picture against the transparent plate by spring action.

U.S. Pat. No. 4,442,617 and U.S. Pat. No. 4,545,140 show other types of devices for displaying photographs, signs and the like.

U.S. Pat. No. 2,730,825 shows a device of the type stated in the introduction. Thus, the device comprises a front plate in the form of a transparent member having a uniformly curved cross-section between a pair of parallel side edges, and having first and second abutment members arranged along respective ones of the parallel side edges at the concave side of the member, for receiving a tag or price label and holding this in flexed engagement between the abutment members in such a manner that the tag has an arched cross-section. Further, the device comprises a substantially vertical supporting flange, depending integrally from an upper edge of the transparent member, and being adapted for interlocking between mating elements arranged on a shelf where the device is to be mounted.

It is here the question of a device for a quite special purpose, more specifically a price tag holder for shelf mounting. In order to rest against the uniformly curved front plate between the abutment members, the price tags have to be accurately adapted, or they must be made of such a rigid material that they are self-supporting and retained between the abutment members without resting against the front plate. The construction of the device lacks flexibility and is limited to its particular field of use.

It is an object of the invention to provide a flexible display device making it very simple to change the message which is to be presented, in that it may be exchanged in a simple and quick manner without the use of separate or loose fixing means, and without the use of tools or other expedients.

Another object of the invention is to provide a display system making possible a substantial reduction of the costs in the production and display of information, advertising, text and picture material, and wherein the whole system can be reused and loose parts, such as screws, pins, clips or the like, are not required.

A further object of the invention is to provide a display device giving the possibility of many different ways of mounting or placing, for example suspended on a wall or placed freely standing on a base, with the possibility of horizontal or vertical display of the message at different angles or in different planes.

A still further object of the invention is to provide a display means giving the possibility for building-in of a light source as part of the device, for illumination of the displayed information from the rear side.

For the achievement of the above-mentioned objects there is provided a device of the introductorily stated type which, according to the invention, is characterized in that the abutment members are gripping edges constituted by folded side edge portions of the front plate, and that the supporting means consists of a support element of a resilient material having opposite end portions shaped for releasable engagement with the gripping edges of the front plate, the element being arranged for resilient snap-in of the end portions to engagement with the gripping edges of the front plate.

The display object or display plate in the device according to the invention has to consist of a material which is sufficiently flexible to be able to be bent and introduced between the gripping edges of the front plate, but simultaneously has a rigidity causing the display plate to be stretched between the gripping edges and the inside of the front plate. A suitable material may be paper, paperboard, cardboard, plastic material or the like, placed in one or more layers so that one achieves a suitable rigidity and/or translucence, or a desired colour effect or another visual or optical effect.

The display device is well suited for self-production of information material, all the way from the material to be displayed until finished mounting. The material for example may be produced by means of home computer equipment, for example a PC or a laser or ink printer or a plotter.

The invention will be further described below in connection with exemplary embodiments with reference to the drawings, wherein FIG. 1 illustrates the simple mounting of a display plate in a front plate in the device according to the invention;

FIGS. 2*a–d* show cross-sections of alternative designs of front plates;

FIGS. 3 and 4 show a side view and a rear view, respectively, of a first embodiment of a device according to the invention;

FIGS. 5*a–b* show perspective views of an additional embodiment, with a plate-shaped support element shown separated from and in engagement with the front plate, respectively;

FIGS. 6*a–c* show cross-sections of the embodiment in FIG. 5 in different mounting phases;

FIGS. 7*a–d* show cross-sections of an embodiment of the device wherein the support element is designed for wall mounting;

Figure 1:
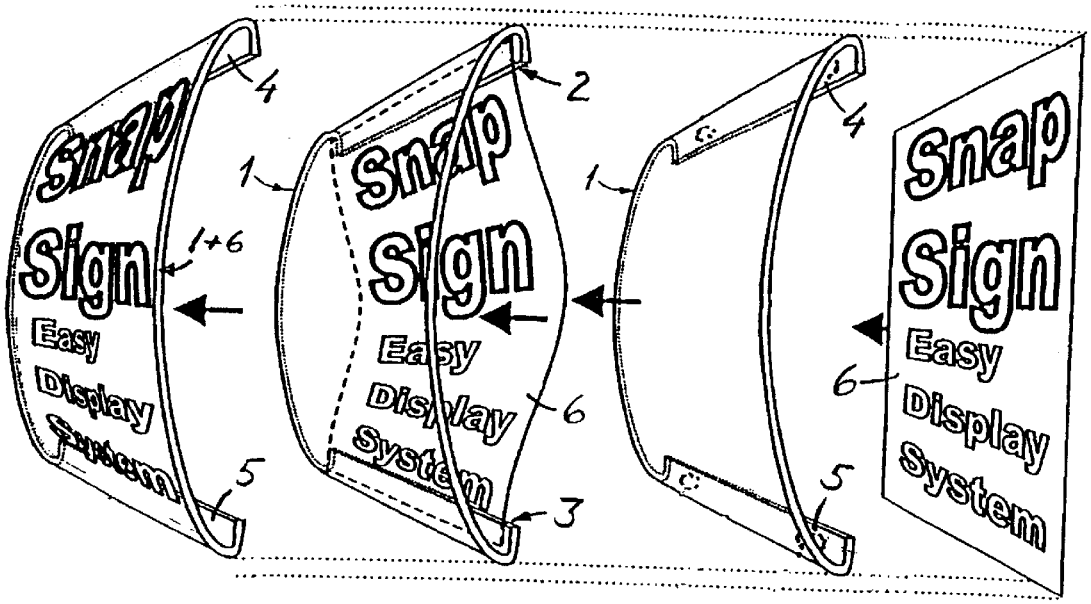

The device according to the invention comprises a front plate which is designed so that it replaces, in one piece, front glass, frame and appurtenant fixing elements in the traditional framing systems. FIG. 1 shows such a front plate 1 which, for example, may consist of a transparent plastic material and which has a uniformly curved cross-section between a pair of parallel side edges 2 and 3. The side edge portions are flanged or folded so that, at the concave side of the front plate, there are formed gripping edges 4 and 5 directed towards each other, for gripping of adjacent edge portions of a display sheet or a display plate 6 which is to be mounted in the front plate, as illustrated in FIG. 1.

The gripping edges 4, 5 may extend continuously along the whole width of the front plate 1, or only along parts of the width thereof. The distance between the gripping edges is less than the corresponding longitudinal extent of the display plate 6 which is to be retained, so that the display plate is fixed between the gripping edges and is curved so that it rests against the adjacent side face, i.e. the inner side, of the front plate 1. The display plate thereby is kept in place because of the tensioning effect, without additional fixing means. The effect of the arched shape and of the fact that the display plate lies smoothly against and behind the front plate, gives a neat and attractive presentation of the message, even if it is produced on a usual paper sheet.

Figure 2:
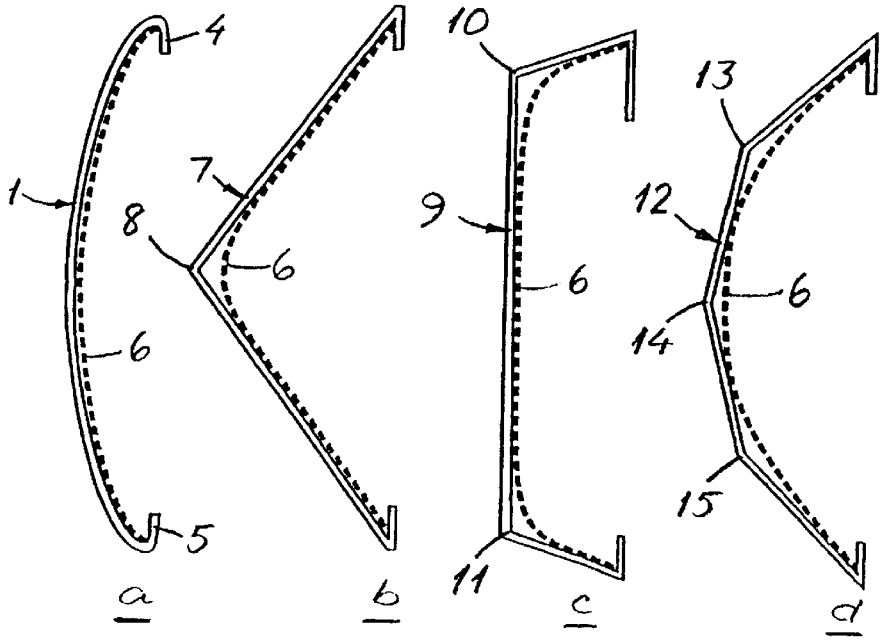

Even if a curved shape of the front plate generally will be preferred, as shown in FIGS. 1 and 2*a*, the front plate does not need to have such a shape. Examples of alternative cross-sectional profiles are shown in FIGS. 2*b*–2*d*. Thus, FIG. 2*b* shows a front plate 7 which is angularly bent at a central place 8 parallel with the gripping edges of the display plate 6, FIG. 2*c* shows a plate 9 which is angularly bent at two places 10 and 11, and FIG. 2*d* shows a plate 12 which is angularly bent at three places 13, 14, 15 parallel with the gripping edges. As appears, the display plate 6 in these embodiments are only supported by larger or smaller parts of the front plate, at a distance from the angularly bent portions.

Figure 3:
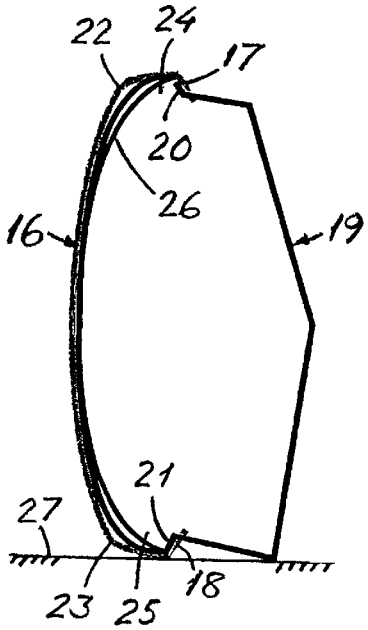
Figure 4:
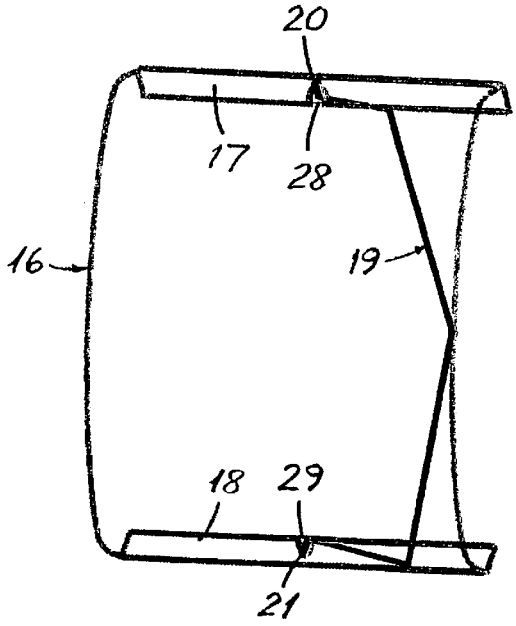

A first embodiment of a complete display device according to the invention is shown in FIGS. 3 and 4. As appears, the device comprises a front plate 16 having opposite gripping edges 17, 18 which are in engagement with a supporting means 19. The supporting means 19 generally consists of a support element of a resilient material having opposite end portions 20, 21 which are designed or shaped for releasable engagement with the gripping edges of the front plate 16, the element being arranged for resilient snap-in of the end portions to engagement with the gripping edges of the front plate.

As shown, the front plate 16 in this embodiment is generally uniformly curved in a region between the gripping edges 17, 18, but at a distance from each of the gripping edges has a bent portion 22 and 23, respectively, so that, in the region between the bent portion and each gripping edge 17 and 18, there is formed a passage or pocket 24 and 25, respectively, serving to receive a larger or smaller part of the relevant edge portion of a display plate 26 which is fixed between the gripping edges. Said pockets, which arise as a result of the fact that the front plate is not uniformly curved, thus entails that display plates having a somewhat varying width can be fixed in the intended manner between the gripping edges, in abutment against the front plate with a larger or smaller part of their central portion, depending on the size of the display plate.

In the embodiment of FIGS. 3 and 4, the support element 19 consists of a resilient metal wire which has been bent to general U-shape between the end portions 20 and 21. In FIG. 3, the metal wire 19 is fixed between the gripping edges 17 and 18, so that it projects therefrom with its leg portions, for example at generally right 30 angles, to support the front plate on a base 27, as appears from the Figure. In FIG. 4, on the other hand, the support element is placed in a position in which its leg portions extend along the front plate 16, so that it may be used as a suspension means for suspending the display device on a wall or the like, in a position wherein the front plate 16 then is turned 90° counterclockwise relative to the position in FIG. 4.

As appears from FIG. 4, the gripping edges 17, 18 of the front plate in this embodiment are provided with a pair of opposite notches 28 and 29, for receipt and retention of the end portions 20, 21 of the metal wire 19.

Figure 5:
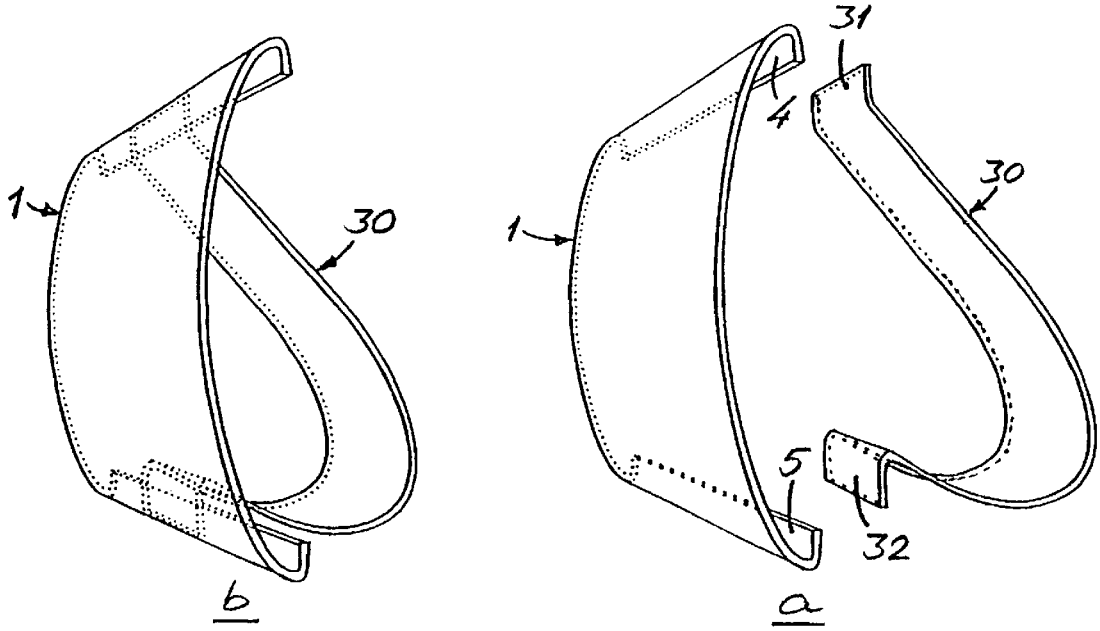

FIG. 5 shows an embodiment of the display device wherein the front plate 1 corresponds to the embodiment in FIG. 1, but wherein the supporting means consists of a plate-shaped element 30 in which the opposite end portions are mutually parallel side edge portions 31 and 32 which are adapted for engagement with respective ones of the gripping edges 4, 5 of the front plate 1. In this embodiment, the plate-shaped element 30 has a width which is substantially less than the width of the front plate 1 in the direction along the gripping edges 4 and 5.

Figure 6:
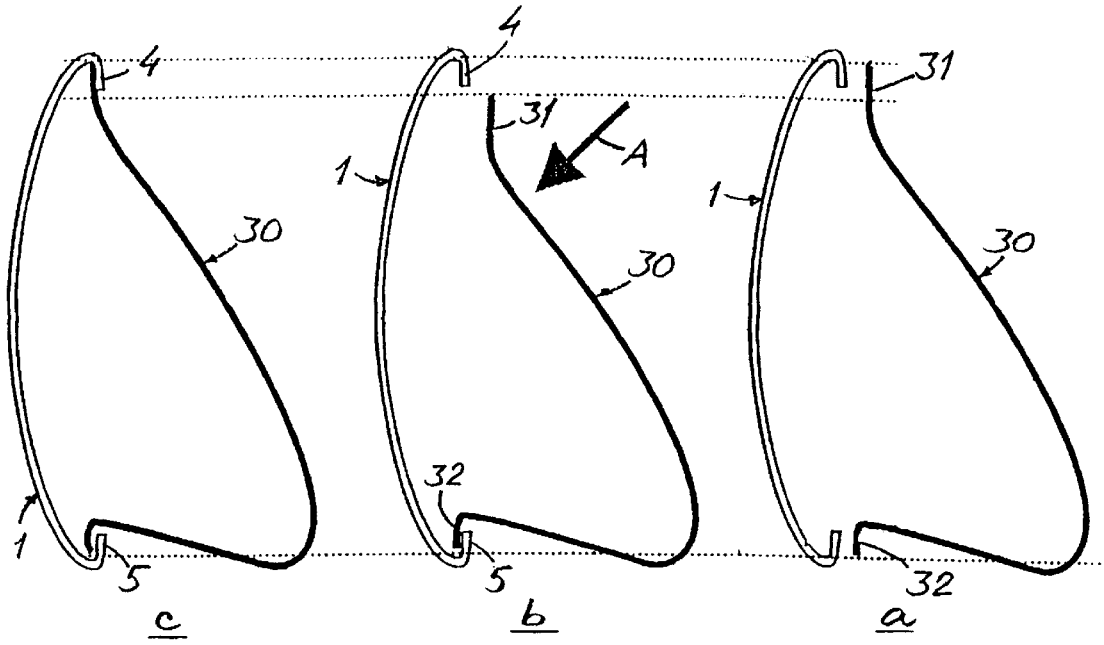

FIGS. 6*a–c* illustrate how the support element 30 is mounted simply and quickly in the front plate 1. As shown in FIG. 6*b*, the lower edge 32 of the support element is placed within the gripping edge 5, and the upper part of the support element thereafter is pushed somewhat downwards in the direction of the arrow A, so that its upper edge 31 comes beneath and inside of the upper gripping edge 4 of the front plate. The element 30 thereafter is allowed to spring back, so that its upper edge comes into engagement behind the gripping edge 4. The spring action of the material in the support element entails that the element is kept in place without any additional locking means. Mounting and dismounting of the support element thereby can take place very rapidly and simply, without a tool or other mounting parts.

Figure 7:
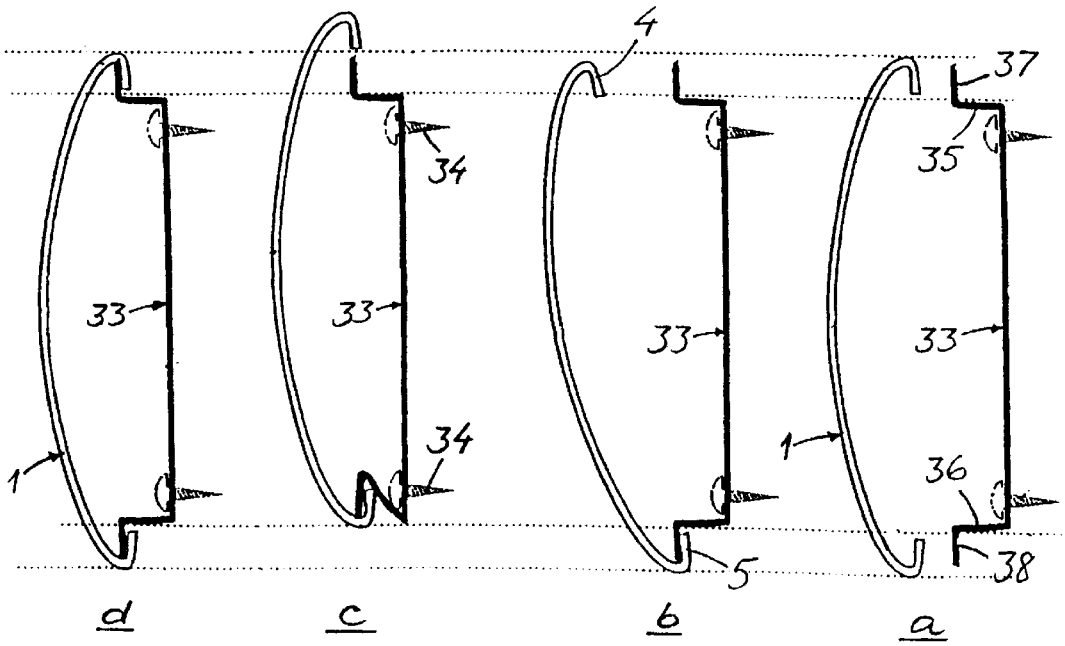

FIG. 7 shows an embodiment of the display device which is adapted for wall mounting. The front plate 1 of the device corresponds to the embodiment in FIGS. 1 and 5, but the support element here is constituted by a mounting bracket 33 having a generally U-shaped cross-section, and of which the web part is provided with suitable holes for mounting by means of pins or screws 34. The free end portions of the projecting legs 35, 36 are formed with edge flanges 37, 38 extending in the opposite direction and being adapted for engagement with the gripping edges 4, 5 of the front plate 1. FIGS. 7*a–d* illustrate how the front plate can be mounted on the support bracket.

As appears from the drawing figures, the support element may have a variety of configurations and consist of different resilient materials, such as plastics, metal sheet or metal wire. The cross-section for example may be arcuate, V-shaped, U-shaped, or combinations thereof, and it may be symmetrical or asymmetrical. In all cases the support element will have end portions or edge portions which are adapted for engagement with the gripping edges of the front plate, and be shaped so that it can be squeezed together in order to be snapped into or removed from the front plate.

Figure 8:
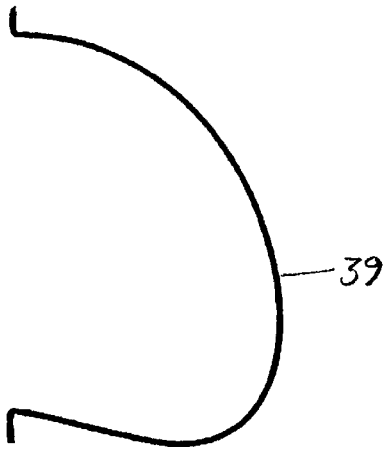
FIGS. 8 and 9 show cross-sections of examples of support element profiles.
Figure 9:
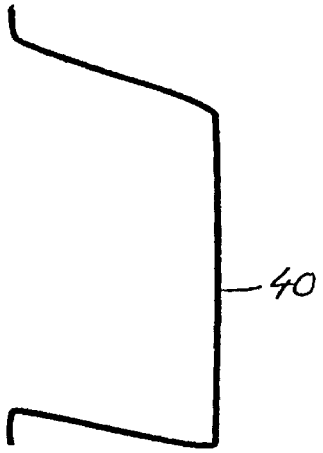

FIGS. 8 and 9 show examples of support element profiles, where FIG. 8 shows an arched support element 39 and FIG. 9 shows a generally U-shaped or channel-shaped support element 40, but where both elements have a somewhat asymmetrical shape.

Figure 10:
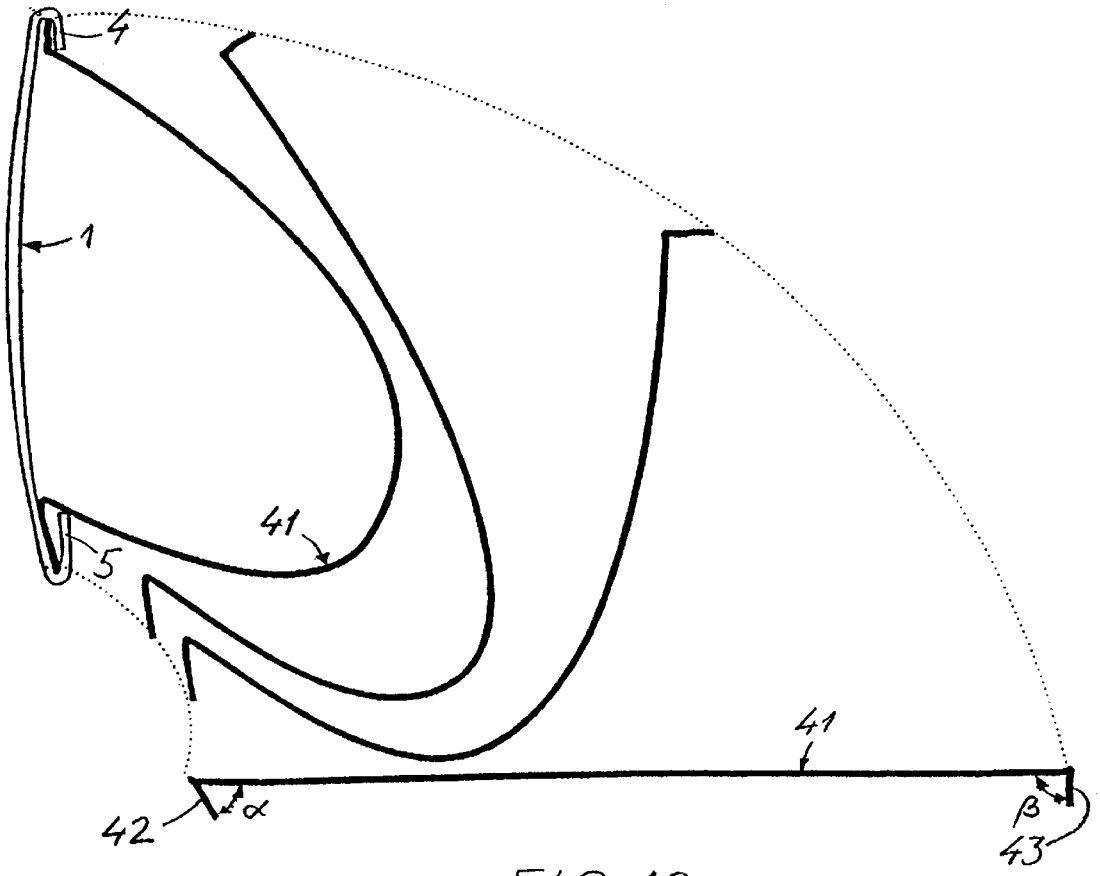
FIG. 10 shows an embodiment having an initially flat support element which can be bent to the desired shape for interconnection with an appurtenant front plate.

FIG. 10 shows a support element 41 which, at the starting point, is a flat flexible plate having folded end edge portions 42 and 43. This embodiment enables flat packing of a set consisting of a front plate and a support element. The Figure illustrates how the support element 41 is bent and with its edge portions 42, 43 is moved into engagement with the gripping edges 4, 5 of a front plate 1. As appears from the Figure, the edge portions 42, 43 form different angles $\alpha$ and $\beta$ with the remaining part of the support element 41. By varying the angles $\alpha$ and $\beta$, one may vary the curve when bending the support element, and thereby the angle in which the front plate will be standing when the display device is placed on a base.

Figure 11:
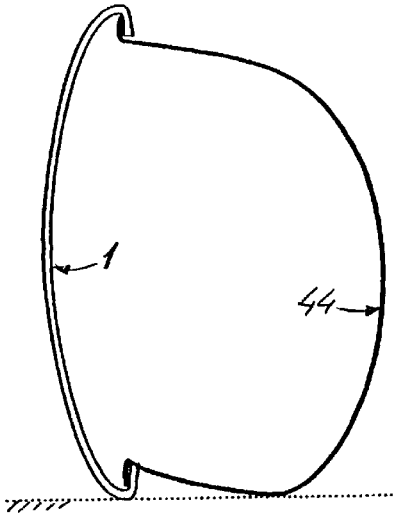
FIGS. 11 and 12 show an embodiment similar to FIGS. 5 and 6, having an asymmetrical support element enabling the device to be placed on a base in a first position having a first angle of inclination (FIG. 11), or in an inverted position having a different angle of inclination (FIG. 12)
Figure 12:
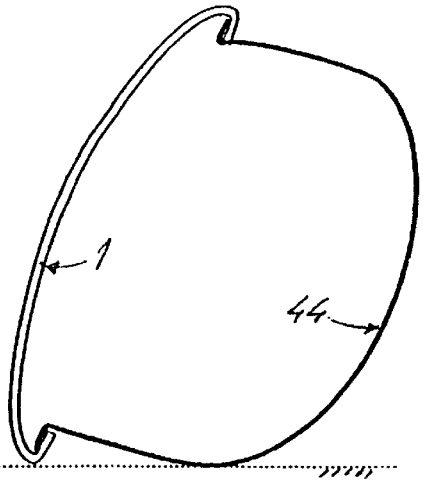

In the illustrated case, the angle $\alpha$ is smaller than the angle $\beta$, and when bending the element the angle $\alpha$ therefore gives a curve having a smaller radius of curvature than the angle $\beta$. This results in an asymmetrical support element giving different angles of the position of the front plate in relation to the base, dependent on how the support element is inserted into the front plate. This is illustrated in FIGS. 11 and 12 wherein an asymmetrical support element 44 is placed in the front plate 1 in a first position in FIG. 11, and in an inverted position in FIG. 12. As will be understood, the same effect is obtained by turning the entire display device upside down.

By means of varying length and flexibility of the material in the support element, and by varying said angles $\alpha$ and $\beta$, an infinite number of variation possibilities may be obtained with respect to the profile of the support element. When the support element further is plate-shaped and has a substantially smaller width than the width of the front plate in the direction along the gripping edges, the support element can be placed "asymmetrically", i.e. in different positions along the front plate. When the front plate then is placed on edge, i.e. turned 90° relative to its orientation in the preceding Figures, for example FIG. 5, the angle of inclination of the front plate, when the display device is placed on a base, may be varied as desired by displacing the support element along the gripping edges of the front plate.

Figure 13:
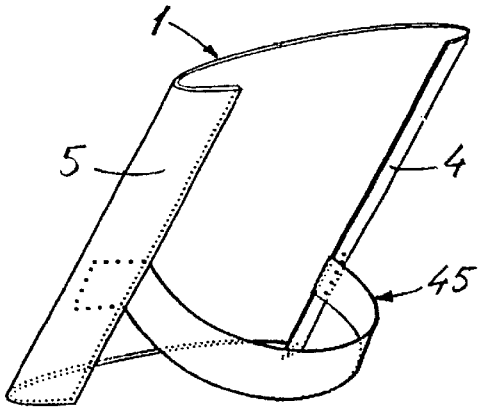
FIGS. 13–16 show different embodiments of the device, wherein the front plate is rotated 90° relative to the preceding embodiments, and wherein a plate-shaped support element has a different placing along the front plate.
Figure 14:
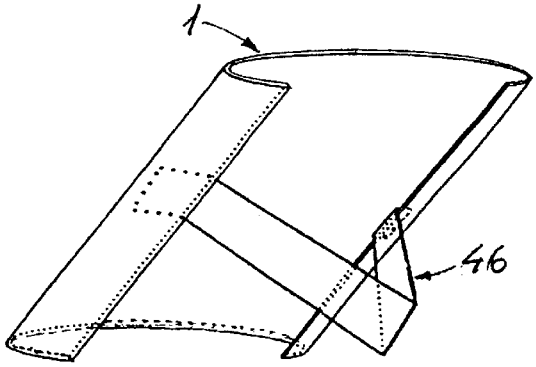
Figure 15:
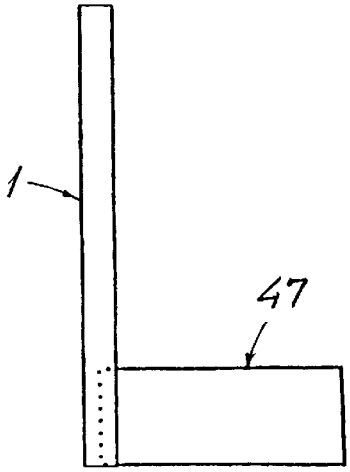
Figure 16:
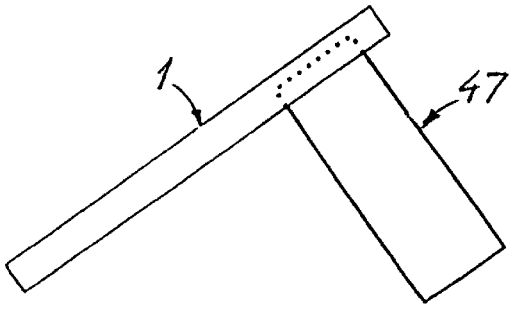

Examples of the above-mentioned variant are shown in FIGS. 13–16. Thus, FIG. 13 shows an embodiment wherein the front plate 1 is placed on edge, i.e. has upstanding gripping edges 4, 5, and wherein an arcuate support element 45 is placed somewhat below the middle of the gripping edges. FIG. 14 shows a similar embodiment wherein a V-shaped support element 46 is placed somewhat above the middle of the gripping edges of the front plate. FIGS. 15 and 16 show side views of an embodiment wherein a support element 47 is placed at an end of the gripping edges of an upstanding front plate 1. In FIG. 15, the support element 47 is placed at the lower end of the gripping edges, so that the front plate has a vertical position when the support element rests against a horizontal base. In FIG. 16, the support element 47 is placed at the upper end of the gripping edges, so that the front plate has an approximately maximum tilt.

Figure 17:
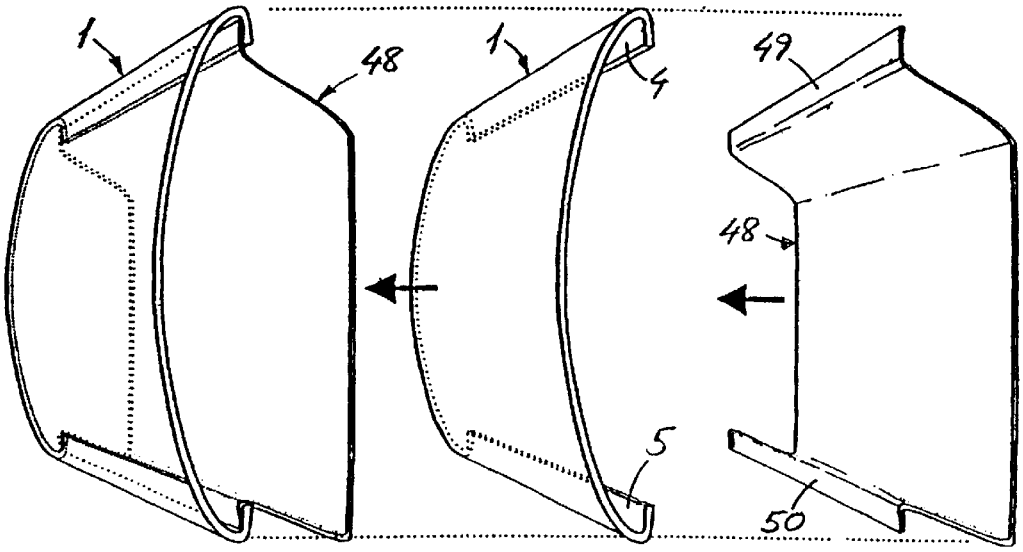
FIG. 17 shows an embodiment wherein the support element is a plate having the same width as the front plate.

FIG. 17 shows an embodiment of the display device wherein the support element 48 thereof is a plate having the same width as the front plate 1. The support element 48 is bent to an asymmetrical cross-sectional shape corresponding to the profile in FIG. 9, and has folded edge portions 49 and 50 which are adapted for engagement with the gripping edges 4 and 5 of the front plate. The support element may be provided with holes (not shown) for wall mounting by means of suitable fasteners.

The embodiment in FIG. 17 is particularly suited for use as a light shaft where there is wanted a background illumination of the display plate or "the message" behind the front plate. The assembly of the front plate 1 and the support element 48 then is provided with a locking and sealing end cover 51 at each end, as shown in the exploded perspective view in FIG. 18, so that there is formed a closed space 52 which is defined by the front plate, the support element and the end covers. In the closed space there is mounted a light source, for example in the form of one or two luminous tubes 53, as shown in FIG. 19. The necessary drive unit and supply line for power supply are not shown. The illuminated display plate 6 is shown stippled in FIG. 19.

Figure 18:
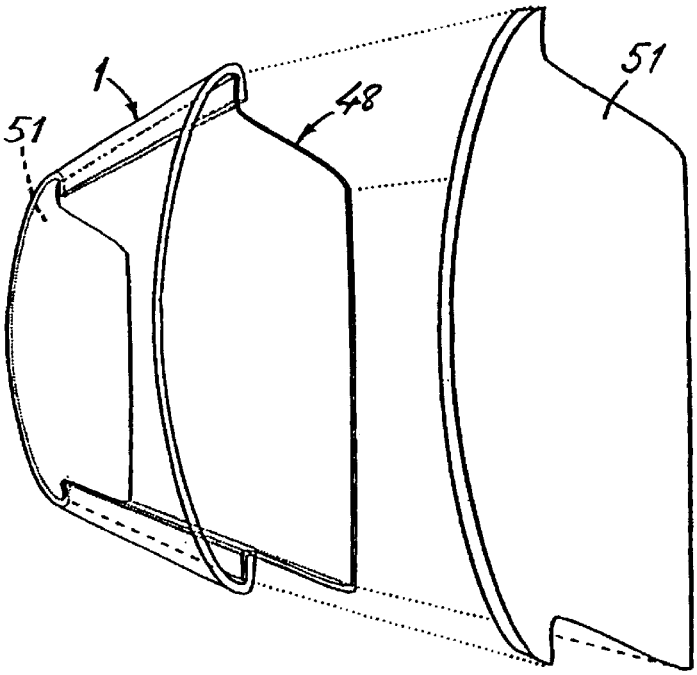
FIG. 18 shows an embodiment wherein the front plate and the support element correspond to FIG. 17, but are combined with end covers for the formation of a closed space behind the front plate.
Figure 19:
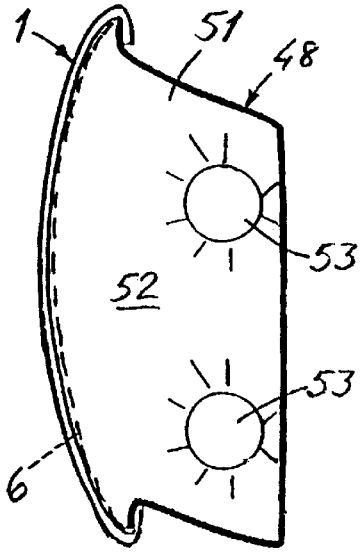
FIG. 19 shows a cross-section of the embodiment in FIG. 18, wherein a pair of light sources are placed in the closed space behind the front plate.

The design of the light shaft in FIGS. 18 and 19 will be well suited for outdoor assembly, since the asymmetrical cross-sectional shape of the support element will contribute to the light shaft being rainproof, as the top part and bottom part of the support element slope downwards from the end edge portions and thereby lead water and moisture downwards and away from the joints with the front plate.

What is claimed is:

1. A device for displaying information, comprising a wholly or partly transparent front plate (1; 16) having at least a partly curved or bent cross-section between a pair of essentially parallel first edges (2, 3), and having first and second abutment members (4, 5; 17, 18) arranged along respective essentially parallel second edges (2, 3) on the concave side of the front plate (1, 16), for retaining at least one flexible display sheet (6) of suitable size and rigidity to be snapped into a fixed, curved relationship with the front plate between the abutment members; and a supporting means (19; 30; 33; 41) for supporting the front plate (1; 16) against a supporting surface, (27); wherein the abutment members are gripping edges for each display sheet (4,5; 17, 18), and wherein the supporting means consists of a support element (19; 30; 33; 39–41; 44–48) of a resilient material having opposite end portions (20, 21; 31, 32; 37, 38; 42, 43) that are shaped for releasable engagement with the gripping edges (4, 5; 17, 18) of the front plate (1; 16), the support element being shaped for resilient snap-in of its end portions into engagement with the gripping edges of the front plate, and for support of the front plate (1; 16) by an intermediate support portion of the support element between the end portions of the support element that is bent outwards and away from the concave side of the front plate.

2. A device according to claim 1, wherein the front plate (16) is generally uniformly curved in a region between the gripping edges (17, 18), and wherein at a distance from at least one of the gripping edges the front plate (16) has a bent portion (22 resp. 23) so that, in the region between the bent portion and the gripping edges (17 resp. 18), there is formed a pocket (24 resp. 25) for receipt of a larger or smaller part of the relevant edge portion of a display sheet (26) that is to be fixed between the gripping edges (17, 18).

3. A device according to claim 1, wherein the front plate (7; 9; 12) is angularly bent at one or more places (8 resp. 10, 11 resp. 13, 14, 15) parallel with the gripping edges (4, 5), for achieving the bent cross-section.

4. A device according to one of the claims 1–3, wherein the support element consists of a resilient metal wire (19) that is bent to a general U-shape between the end portions (20, 21).

5. A device according to claim 4, wherein the gripping edges (17, 18) of the front plate (16) are provided with at least one pair of opposite notches (28, 29) for receiving and retaining the end portions (20, 21) of the metal wire (19).

6. A device according to one of the claims 1–3, wherein the support element (30; 33; 41; 44–48) consists of a plate-shaped element and wherein the opposite end portions are mutually parallel end edge portions (31, 32; 37, 38; 42, 43) that are adapted for engagement with the gripping edges (4, 5) of the front plate (1).

7. A device according to claim 6, wherein the plate-shaped element (30; 33; 41; 44–47) has a width that is substantially less than the width of the front plate (1) in the direction along the gripping edges (4, 5).

8. A device according to claim 6, wherein the plate-shaped element (48) has a width corresponding to the width of the front plate (1) in the direction along the gripping edges (4, 5).

9. A device according to claim 8, wherein at each end of the opposite side edges of the front plate (1) and the plate-shaped element (48) that are not in engagement with each other, there is placed an end cover (51) for the provision of a closed space (52) defined by the front plate (1), the plate-shaped element (48) and the end covers (51).

10. A device according to claim 9, wherein in the closed space (52), there is placed a light source (53) for background illumination of an information sheet (6) retained by the front plate (1).

11. A device according to claim 6, wherein the support element (33) constitutes a support bracket having an essentially U-shaped cross-section and being provided with holes for passages of fastening elements (34) for attachment to a supporting surface.

12. A device according to claim 6, wherein the support element (41) has folded end edge portions (42, 43) forming different angles ($\alpha$,$\beta$) with the adjacent part of the support element (41), the support element having an assymmetrical cross-sectional shape.

* * * * *

UNITED STATES PATENT AND TRADEMARK OFFICE

CERTIFICATE OF CORRECTION

PATENT NO. : 6,742,294 B1
DATED : June 1, 2004
INVENTOR(S) : Stein Arne Fossum

It is certified that error appears in the above-identified patent and that said Letters Patent is hereby corrected as shown below:

Column 6,
Line 62, please delete "essentially parallel".
Line 62, please delete "(2, 3)".

Column 7,
Line 4, following the phrase "gripping edges" please insert -- (4, 5; 17, 18) --.
Line 5, please delete "(4,5; 17, 18)".

Signed and Sealed this

First Day of March, 2005

JON W. DUDAS
*Director of the United States Patent and Trademark Office*